United States Patent [19]

Maierbacher

[11] Patent Number: 4,592,699

[45] Date of Patent: Jun. 3, 1986

[54] CLAMPING ASSEMBLY

[75] Inventor: Joseph Maierbacher, Wellsville, N.Y.

[73] Assignee: Dresser Industries, Inc., Dallas, Tex.

[21] Appl. No.: 585,953

[22] Filed: Mar. 5, 1984

[51] Int. Cl.[4] ..... F01D 25/24

[52] U.S. Cl. ..... 415/126; 415/167; 415/219 R; 403/369

[58] Field of Search ..... 415/126, 127, 134, 139, 415/150, 157, 167, 219 R; 403/369, 370, 374

[56] References Cited

U.S. PATENT DOCUMENTS

| | | | |
|---|---|---|---|
| 2,247,378 | 7/1941 | Hinrichs | 415/126 X |
| 2,247,387 | 7/1941 | Johnson et al. | 415/126 X |
| 2,247,423 | 7/1941 | Webster, Jr. | 415/126 X |
| 3,365,123 | 1/1968 | Seabury, III | 415/219 R |
| 3,544,233 | 12/1970 | Brown et al. | 415/126 |
| 3,942,907 | 3/1976 | Meylan | 415/126 |
| 4,380,405 | 4/1983 | Kaneki et al. | 415/219 R X |

FOREIGN PATENT DOCUMENTS

| | | | |
|---|---|---|---|
| 5616 | 11/1979 | European Pat. Off. | 415/219 R |
| 80745 | 6/1983 | European Pat. Off. | 415/219 R |
| 1289535 | 2/1969 | Fed. Rep. of Germany | 415/219 R |

*Primary Examiner*—Robert E. Garrett
*Assistant Examiner*—Joseph M. Pitko

[57] ABSTRACT

A clamping assembly for adjusting the relative spacing between the finger nozzles and the blades of a turbine wheel in turbine assembly which also enhances the distribution of high pressure steam loads between the steam chest and turbine casings of the assembly. The clamping assembly includes a plurality of adjustable clamps secured about the periphery of the casings. Each of the clamps includes a first wedge key on the periphery of the turbine casing, and a second wedge key secured to the steam chest casing by an adjustable fastener. This arrangement enables a workman to adjust the relative positions of the casings to position the finger nozzles relative to the blades by adjusting the fasteners securing the second keys to the steam chest casing.

9 Claims, 6 Drawing Figures

13
39
12
38

3
3
4
4
15
22
27
28
30
32
38

CLAMPING ASSEMBLY

BACKGROUND OF THE INVENTION

1. Field of the Invention

The present invention relates to a clamping assembly for securing a pair of casings in alignment with one another and in particular to an arrangement which utilizes tapered or wedge-shaped keys to align and secure a pair of casings forming a pressure vessel such as encountered in a steam turbine assembly.

2. Description of the Prior Art

In the typical steam turbine assembly, a plurality of steam injection or finger nozzles project into the turbine from the steam chest. As is well known in the art, the distal end of each of the finger nozzles is axially aligned with the blades of the turbine wheel and is secured at a fixed distance from the wheel determined by the various design criteria of the turbine.

Each of the finger nozzles is secured to the steam chest about one of its associated steam ports and extends through a common port into the turbine casing. Thus, it can readily be seen why the steam chest casing must be secured to the turbine casing in a fashion accommodating relatively close alignment between the steam ports in the casings to insure proper spacing and alignment between the finger nozzles and the blades of the turbine wheel.

The partial cross-sectional view shown in FIG. 6 entitled "Prior Art" illustrates one type of aligning device which has commonly been used in the past. As shown in FIG. 6, the steam chest casing 1 is initially positioned on the turbine causing 2 with the finger nozzles 3 projecting into the turbine casing to direct the steam flow into the blades 4 as indicated by the arrow 5. Then, by adjusting a plurality of machine or jacking screws 6 disposed on the opposite sides of the casing, this arrangement enables a workman to adjust the alignment of the steam ports 7 and 8 to obtain the desired axial spacing "S" between the finger nozzles 3 and the blades of the turbine wheel. Once this spacing is established, the casings are secured together by a plurality of holding bolts 9 in the usual manner.

While the foregoing arrangement has been for the most part satisfactory, the jacking screws 6 can only be used to align the casings. As such, they contribute little if anything to the integrity of the connection between the casings or, more specifically, to the distribution of the high pressure steam loads between the two casings after the turbine is put in service.

In addition to the foregoing, the prior art also includes a variety of clamping arrangments for aligning a pair of housings. For example, U.S. Pat. No. 3,365,123 shows a wedge-type adjustable clamp for securing a motor on a blower housing, and U.S. Pat. No. 4,380,405 discloses an arrangement wherein a plurality of slide keys are used to mount a head flange on the casing of a centrifugal compressor. While both of those patents show the use of clamping arrangements, neither teaches the use of a plurality of wedge keys to align a steam chest casing on a turbine casing which also enhances the distribution of high pressure loads throughout both casings.

SUMMARY OF THE INVENTION

The present invention relates to a clamping assembly for aligning the gas ports in a pair of casings and securing them together to form a pressure vessel, and in particular to an apparatus for positioning and securing the finger nozzles of a steam turbine assembly within its turbine casing which also enhances the distribution of high pressure steam loads between the two casings.

The clamping assembly includes a plurality of clamps secured to the steam chest and turbine casings about the periphery of the seal between the two casings. Each of the clamps includes a first wedge key secured to one of the casings and a second wedge key, laterally aligned with the first wedge key, secured to the other casing which is adapted to engage and retain the first wedge key. The invention calls for securing the second wedge key to its respective casing with an adjustable fastener which enables a workman to radially reposition the second key relative to the axis of the turbine. This results in a wedging-like action between the keys which effects relative lateral displacement between the casings. This arrangement enables a workman to utilize the clamping assembly to secure the casings together in a fashion allowing him to accurately position the finger nozzles relative to the blades of the turbine wheel while securely clamping the two casings together to form a relatively rigid pressure vessel which could otherwise be susceptable to bulging-like distortion. Such distortion could lead to separation and failure of the seal between the casings. Finally, after suitable indicia are made in the casings to accommodate their subsequent realignment, conventional holding bolts or the like are secured through the casings in the conventional manner to complete the assembly.

From the foregoing, it can be seen that the invention contemplates a relatively straight-forward and easily fabricated clamping assembly which is particularly suited for securing the steam chest and turbine casings in a steam turbine assembly. However, the invention is not limited to that application and it is to be understood that various changes can be made in the arrangement, form, and construction of the apparatus disclosed herein without departing from the scope and spirit of the invention.

DESCRIPTION OF THE PREFERRED EMBODIMENT

Figure 1:
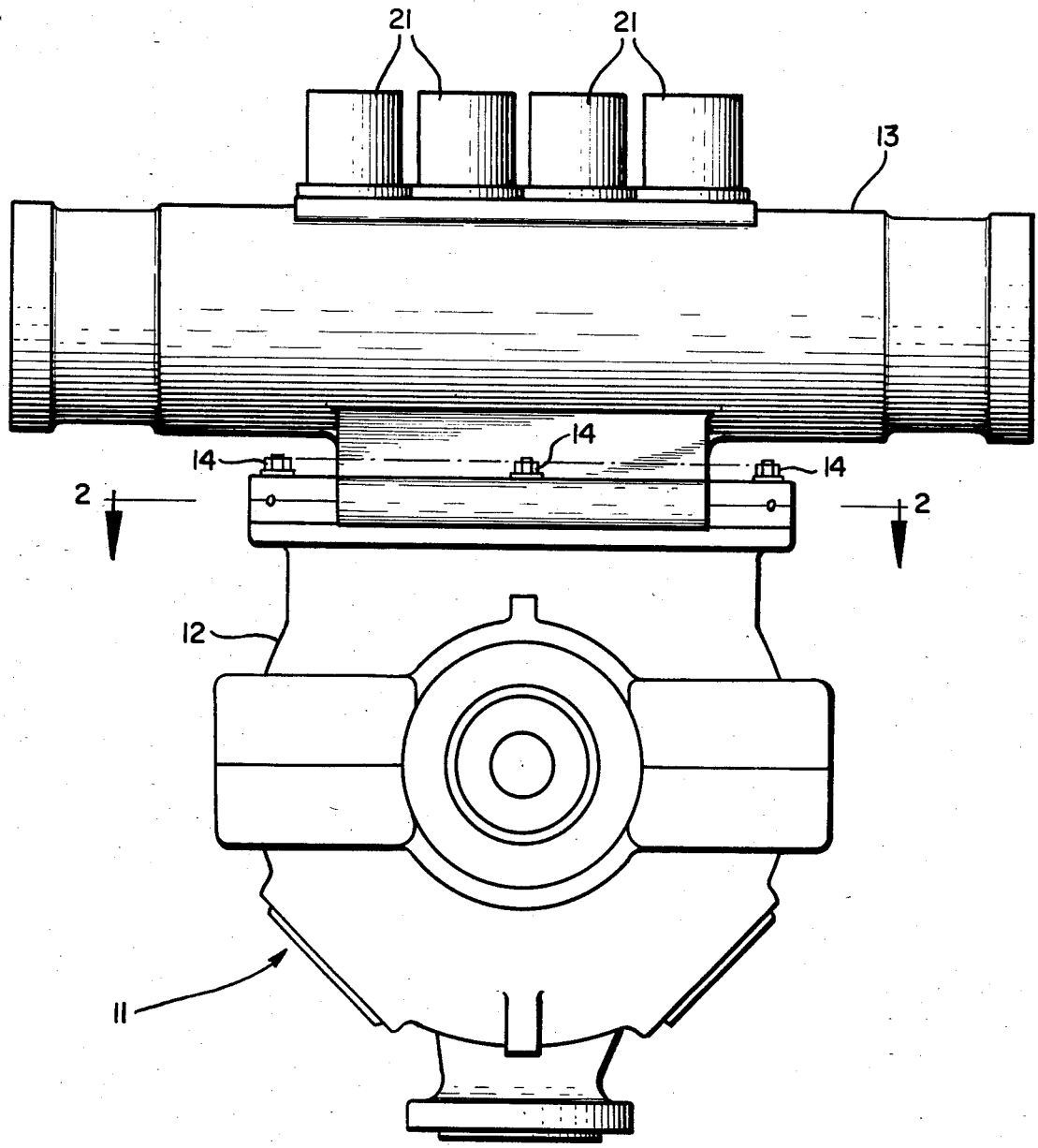
FIG. 1 is an end elevational view showing a steam chest casing mounted on a turbine casing in a steam turbine assembly.

Referring to FIGS. 1–5, the clamping assembly 10 embodying the invention is secured in a steam turbine assembly 11 having a turbine casing 12 and a steam chest casing 13 secured together by a plurality of holding bolts 14 formed of threaded studs 15 and nuts 16 secured about the periphery of the casings as will be described.

The turbine casing 12 is provided with a steam port or duct 17 surrounded by a flat rim 18, and the steam chest casing 13 is provided with a plurality of steam valve ports or ducts 19 surrounded by a rim 20 contigious with the rim 18 on the turbine casing 12. The rim 20 is formed or machined in the bottom of the steam chest casing 13 and is sized to mate with the rim 18 when the casings are secured together with the holding bolts 14. This arrangement effectively forms a gas-tight seal between the casings about the duct 17 and the steam ducts 19 to contain the high pressure steam as it flows into the turbine.

Referring to the drawings, conventional steam regulating valves 21 are secured in the valve ports or ducts 19 to regulate the flow of steam as it flows into the turbine through a plurality of steam injection or finger nozzles 22 projecting into the turbine casing 12 from the bottom of the steam chest casing 13. As is well known in the art, the upper end of each of the finger nozzles 22 is welded or otherwise appropriately secured to the steam chest casing 13, and the lower end of each of the finger nozzles 22 is aligned to direct steam from the steam chest casing into the blades 23 of a turbine wheel 24 mounted on the turbine drive shaft 25.

Figure 4:
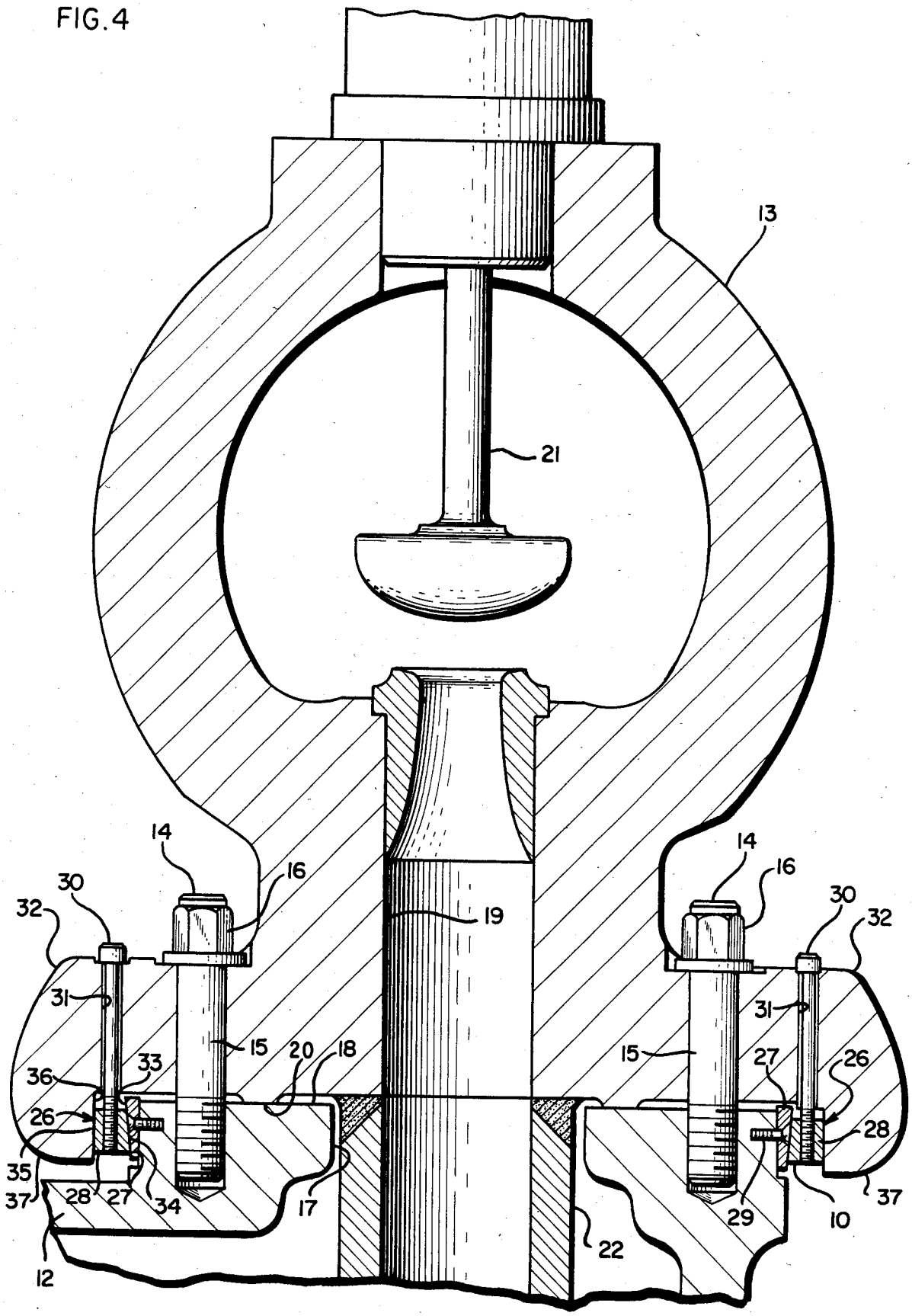
FIG. 4 is an enlarged partial cross-sectional view of steam turbine assembly taken substantially along line 4—4 in FIG. 2 with the steam chest casing in place.
Figure 6:
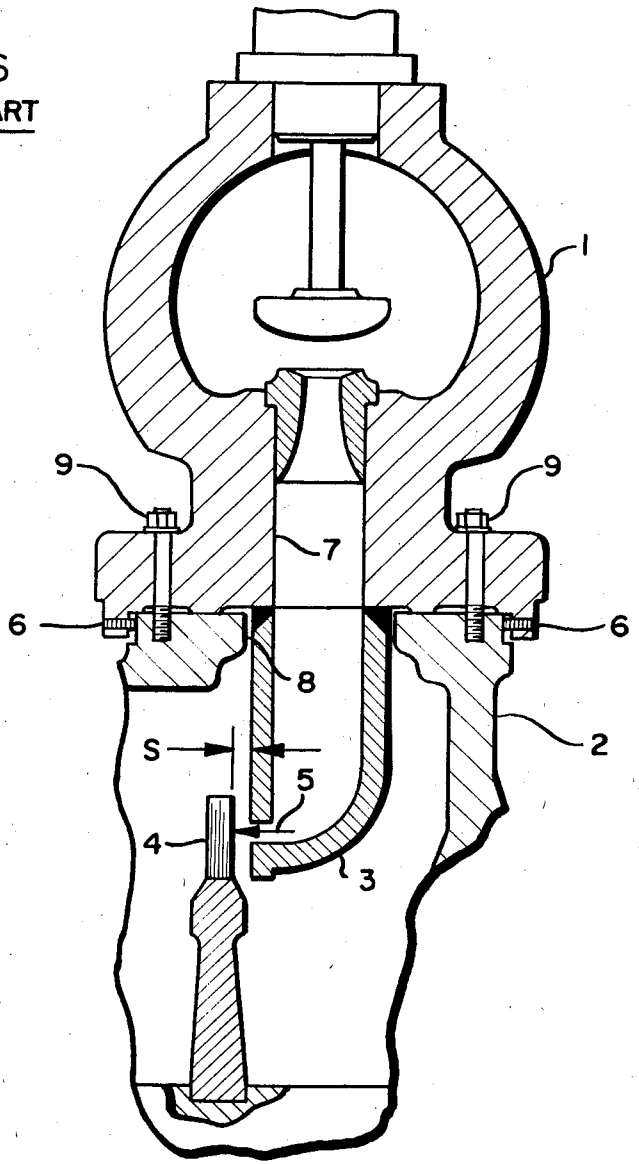
FIG. 6 PRIOR ART
FIG. 6 is a partial cross-sectional view similar to FIG. 5 showing a prior art arrangement for aligning a steam chest casing on a turbine casing.
Figure 5:
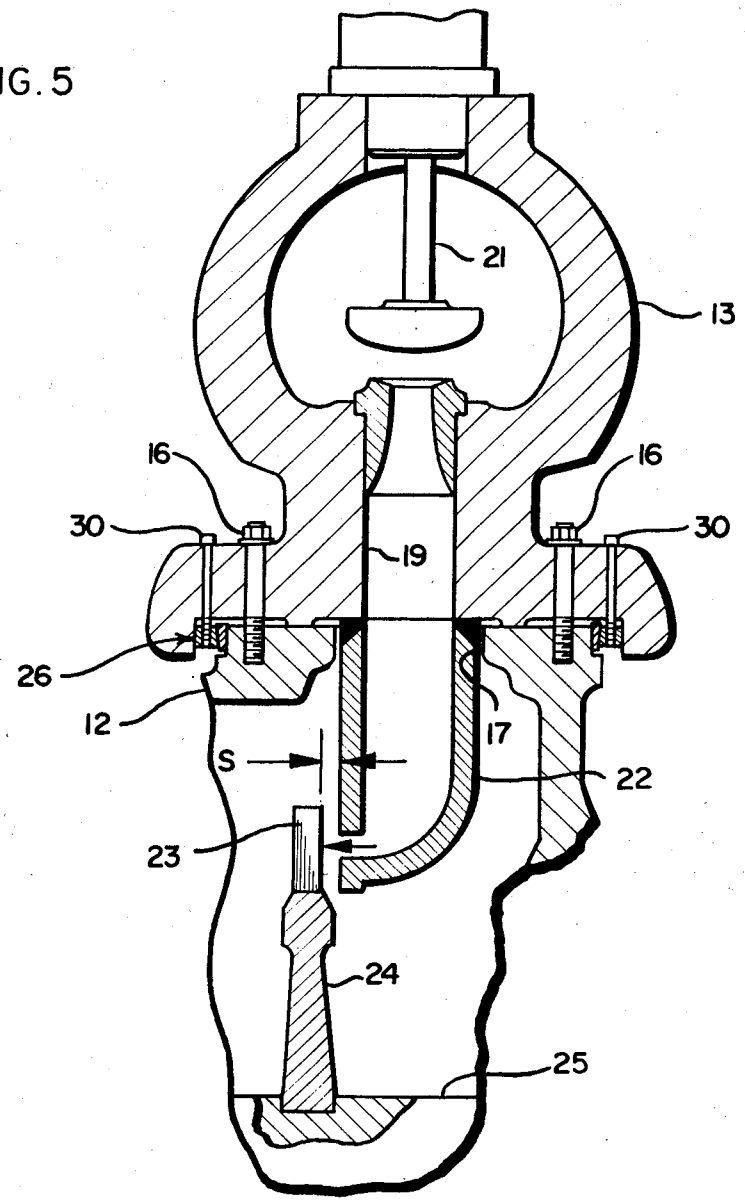
FIG. 5 is a partial cross-sectional view similar to FIG. 4 showing the structural relationship between the finger nozzles and the blades of the turbine wheel.

As best shown in FIG. 4, the clamping assembly 10 includes a plurality of clamps 26 spaced about the periphery of the casings 12 and 13. Although four of the clamps 26 are provided in the preferred embodiment, it is to be understood that more or less could be used depending on the material, size and geometry of the casings. Each of the clamps 26 includes an elongated first wedge-shaped key 27 and an elongated second wedge-shaped key 28. The first wedge-shaped key 27 is secured to the periphery of the turbine casing 12 by a pair of machine screws 29 or other suitable means which, as a matter of convenience, are used to hold it in place while the clamp is assembled, and the second wedge-shaped key 28 is releasably secured to the steam chest casing 13 by a pair of bolts 30. Each of the bolts 30 is threaded into the second key 28 and is secured through a corresponding unthreaded bore 31 in a peripheral flange 32 formed in the base of the steam chest casing 13. This arrangement accomodates selectively positioning the second keys 28 with respect to the first keys 27 by simply turning the bolts 30 to thread them further in or out of the second keys.

As shown in FIG. 4, the first key 27 has a sloping flat outer surface 33 which diverges upwardly and outwardly toward the steam chest casing 13. Conversely, the second key 28 has a flat inner surface 34 which slopes downwardly toward the turbine casing 12. This inner surface 34 is adapted to engage the outer surface 33 of the first key 27 in a fashion entrapping the first key to form a wedged coupling between the two keys securely clamping the casings together. In this regard, it should be noted that each of the second keys is also provided with a flat outer surface 35 which is adapted to slidably abut the flat inner surface 36 of one of the ear-like flanges 37 depending from the flange 32 along the length of the base of the steam chest casing 13. This structure serves to retain and prevent outward displacement of the second key 28 when it is secured to rigidly clamp the casings together.

Figures 2, 3:
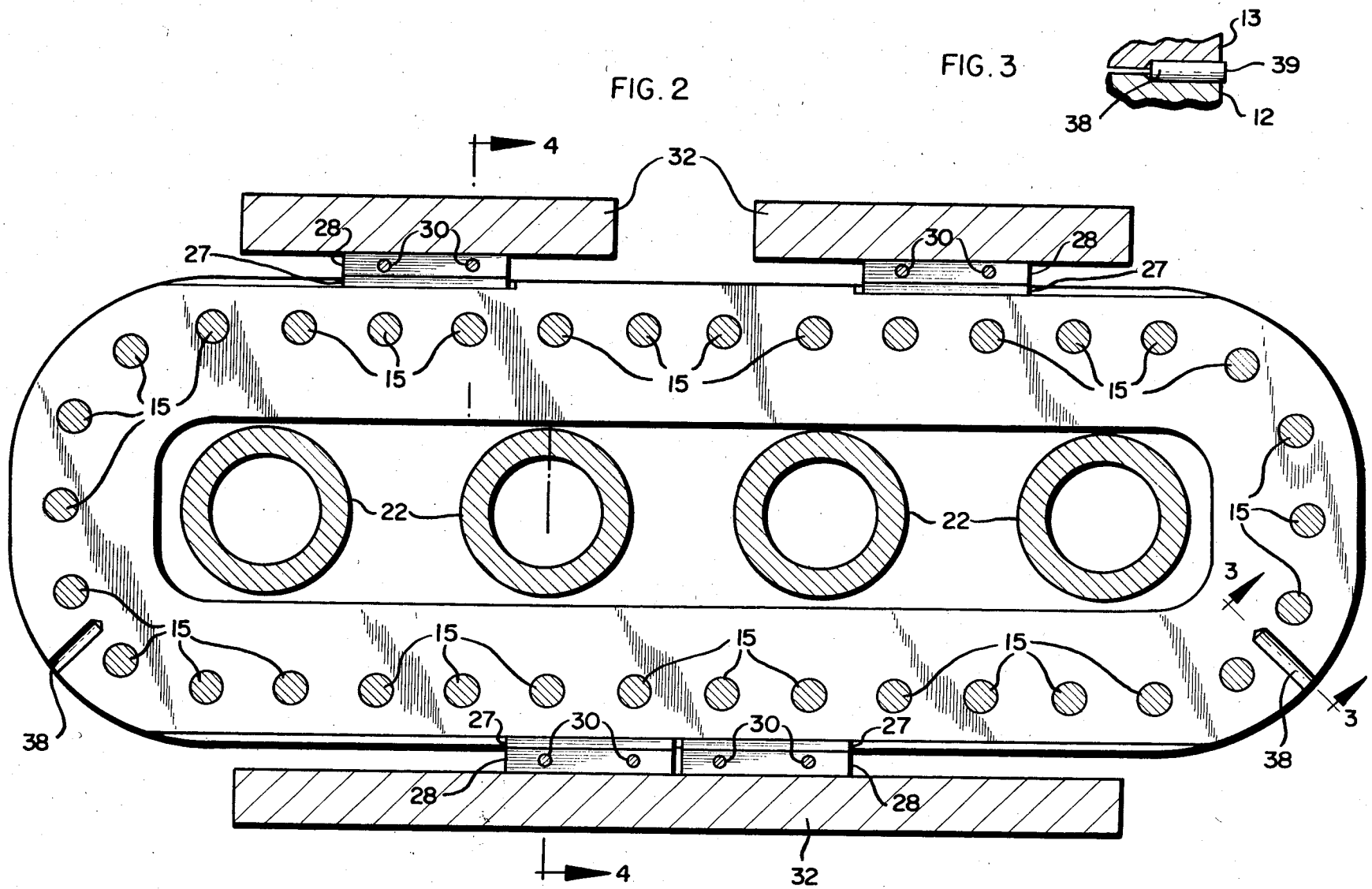
FIG. 2 is an enlarged cross-sectional plan view taken substantially along line 2—2 in FIG. 1.
FIG. 3 is a fragmentary cross-sectional view taken substantially along line 3—3 in FIG. 2 with the steam chest casing in place.

From the foregoing, it can be seen that the invention contemplates a relatively straight-forward and easily fabricated arrangement which enables a workman to quickly and easily adjust the spacing between the finger nozzles 22 and the blades 23 of the turbine wheel 24 while at the same time securely clamping the casings together to enhance the distribution of the steam pressure loads between the two casings. This is accomplished as follows. During the initial assembly process the workman first positions the steam chest casing 13 on the turbine casing 12. Next, the clamps 26 are assembled by simply inserting the bolts 30 through the holes 31 and threading them into their respective second keys until the keys in all of the clamps are engaged. Then, by differentially tightening or loosening the various bolts 30, the workman is able to quickly adjust the relative positions of the casings until the desired spacing "S" is established between the lower ends of the finger nozzles 22 and the blades 23. At this point, after all of the clamps 26 are secured, a pair of holes or grooves 38 are bored at the junction of the two casings and a steel retaining pin 39 is inserted in each of the holes as shown in FIGS. 2 and 3. This arrangement serves to maintain the alignment of the casings while at the same time providing indicia for realigning them during subsequent reassembly of the turbine, it being noted that the axis of the pins 39 are disposed at an acute angle to one another to prevent lateral and longitudinal relative movement between the casings. After this is accomplished, the assembly is completed by securing the nuts 16 on the studs 15 to secure the casings in the usual fashion.

I claim:

1. In a steam turbine assembly having a turbine casing provided with a first port in fluid communication with a turbine wheel mounted within the casing and surrounded by a first rim portion, a steam chest casing provided with a second port surrounded by a second rim portion sized to mate with the first rim portion in an abutting relationship, a steam injection nozzle secured to said second port and projecting through said first port in spaced relationship with blades of said turbine such that a distal end of said nozzle is positioned for steam discharge on said blades of said turbine wheel, and a fastening means adapted to secure the casings together in an abutting fashion forming a gas-tight seal between the rim portions, the improvement comprising a clamping assembly for aligning and clamping the casings together comprising:

a. at least two wedge assemblies, one positioned on one side of said abutting rim portions and the other positioned on an opposed side of said abutting rim portions, each of said wedge assemblies including:
   (i) a first wedge key on the periphery of the turbine casing, said key having an outer surface diverging outwardly from the turbine casing toward the steam chest casing;
   (ii) a second wedge key on the periphery of the steam chest casing having an inner surface adapted to engage the outer surface of the first key; and b. adjustable means coupled to each of said wedge assemblies for adjusting said spacing between said nozzle and said blades along the turbine axis in either direction by loosening one of said wedge assemblies and tightening the other of said wedge assemblies and for clamping said steam chest to said turbine casing by simultaneously tightening both of said wedge assemblies.

2. In the steam turbine assembly of claim 1, said steam chest casing having depending ear-like flanges disposed about its periphery spaced outwardly from said turbine casing; and each of said first and second keys being sandwiched between the turbine casing and one of the ear-like flanges to provide a rigid interconnection between the casings.

3. In the steam turbine assembly of claim 1, indicia on each of the casings indicating alignment of the first and second ports.

4. In the steam turbine assembly of claim 1, said casings having a pair of opposing grooves cooperating to form a bore adapted to receive a retaining pin upon proper alignment of the casings.

5. In the steam turbine assembly of claim 1, said turbine casing having a pair of grooves and said steam chest casing having a pair of opposing grooves cooperating with the grooves in the turbine casing to form a pair of laterally extending bores aligned at an acute angle with respect to one another, and each of said bores being adapted to receive a retaining pin upon proper alignment of the casings.

6. In the steam turbine assembly of claim 1, said adjustable means being a bolt threadably secured to each of said second keys.

7. In the steam turbine of claim 1, second fastening means affixing each of said first wedge keys to the turbine casing.

8. In the steam turbine assembly of claim 1, said steam chest casing having a plurality of said second ports surrounded by said second rim portion, and a steam injection nozzle being provided for each of said ports.

9. In the steam turbine of claim 1, a plurality of pairs of wedge assemblies disposed in mutually opposed relationship about the rim portions of said casings.

* * * * *